US006349494B1

(12) United States Patent
Haggarty-Robbins

(10) Patent No.: US 6,349,494 B1
(45) Date of Patent: Feb. 26, 2002

(54) QUICK CHANGE DISPLAY APPARATUS

(76) Inventor: Donna J. Haggarty-Robbins, 6548 - 51st Ave., NE, Seattle, WA (US) 98115

( * ) Notice: Subject to any disclaimer, the term of this patent is extended or adjusted under 35 U.S.C. 154(b) by 0 days.

(21) Appl. No.: 09/611,347

(22) Filed: Jul. 6, 2000

(51) Int. Cl.[7] ..... G09F 1/06

(52) U.S. Cl. ..... 40/723; 40/724; 40/792; 40/312; 312/319.1

(58) Field of Search ..... 312/245, 242, 312/319.1; 206/817; 40/723, 724, 726, 727, 792, 793, 794, FOR 156, 779, 312, 306, 739, 740

(56) References Cited

U.S. PATENT DOCUMENTS

| | | | |
|---|---|---|---|
| 100,962 | A | 3/1870 | Adams |
| 133,912 | A | 12/1872 | Wilson |
| 1,882,157 | A | 10/1932 | Minton |
| 2,649,799 | A | 8/1953 | Spertus |
| 3,553,872 | A | 1/1971 | Ebner |
| 3,771,244 | A | 11/1973 | Ebner |
| RE33,443 | E | 11/1990 | Ackeret |

*Primary Examiner*—Cassandra H. Davis
(74) *Attorney, Agent, or Firm*—Christensen O'Connor Johnson Kindness PLLC

(57) ABSTRACT

A display apparatus for a display has first member with four sides. The display apparatus includes a transparent restraining member mounted centrally within the four sides of the first member. A second member having four sides and a back is rotatably interconnected with the first member such that the first member can articulate between a first position and a second position. The display apparatus includes holding devices for holding the display as the first member moves from the first to the second position and back to the first position. At least one biasing device exerts an urging pressure for urging the display against the transparent restraining member when the first member is in the first position. The biasing device is preferably a compressible material with memory. The material lies adjacent to the display, distributing the urging pressure along a continuous portion of the display, substantially from one edge to an opposing edge, while the first member is in the closed position. The display apparatus also includes at least one retainer for retaining the biasing device within the second member. The retainer forms a wall of a storage construct within the second member.

8 Claims, 4 Drawing Sheets

QUICK CHANGE DISPLAY APPARATUS

FIELD OF THE INVENTION

This invention pertains to display apparatus, and more particularly to a picture frame with quick change display capabilities.

BACKGROUND OF THE INVENTION

Conventional picture frames are constructed with a backing sheet to hold the picture display flat against the transparent pane of glass. In order to change the display, the backing sheet needs to be removed before a new display can be inserted. Very often this necessitates the removal of the frame from its mount. Other picture frames may provide a rigid backing plate which presses the picture against the transparent glass. The backing plates are held to the walls of the frame by a press fit. These display frames, as well, require some disassembly of the picture frame components in order to remove the current display picture to replace it with a newer picture. Still other picture frames utilize leaf springs to hold the picture against the glass. In order to prevent damage to the display picture, these frames as well require a backing sheet to prevent the leaf spring from wearing the display picture at its pressure points.

In view of the shortcomings of existing picture frames, there is a need for improvements which allow the removal of display pictures from a frame without the additional disassembly or removal of a backing sheet or plate.

SUMMARY OF THE INVENTION

The present invention discloses a display apparatus for a display having a first member with four sides. The display apparatus includes a transparent restraining member mounted centrally within the four sides of the first member. The display apparatus includes a second member having four sides and a back, wherein the first and second member are rotatably interconnected, such that the first member articulates between a first position and a second position. The display apparatus includes holding devices for holding the display as the first member moves from the first to the second position and back to the first position. The display apparatus includes at least one biasing device which exerts an urging pressure for urging the display against the transparent restraining member when the first member is in the first position. The biasing device is preferably a compressible material with memory. The material lies adjacent to the display, distributing the urging pressure along a continuous portion of the display while the first member is in the closed position. The display apparatus also includes at least one retainer for retaining the biasing device within the second member.

In the preferred embodiment of a display apparatus constructed in accordance with the present invention, the urging pressure is evenly applied along a portion of the display from substantially one edge to the other edge. The retainer forms a portion of a storage construct. There is also a second biasing device, and a second retainer, the retainer forming a portion of a storage construct. The holding device of the preferred embodiment includes a first and a second spring loaded gripper for holding the display in the first member without the use of a backing sheet while the first member moves from a first closed position to a second open position. The preferred embodiment further uses a foam rubber-like material with a nondamaging contact surface as a first and second biasing device.

By the use of a display apparatus constructed in accordance with the present invention, changing pictures is accomplished without disassembly of the picture frame components and without the need to remove the frame from its mount. In addition, the display apparatus of the present invention urges a picture against the glass pane without causing damage to the display. One further advantage of the display apparatus constructed in accordance with the present invention inheres in its ability to form storage constructs.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

Figure 1:
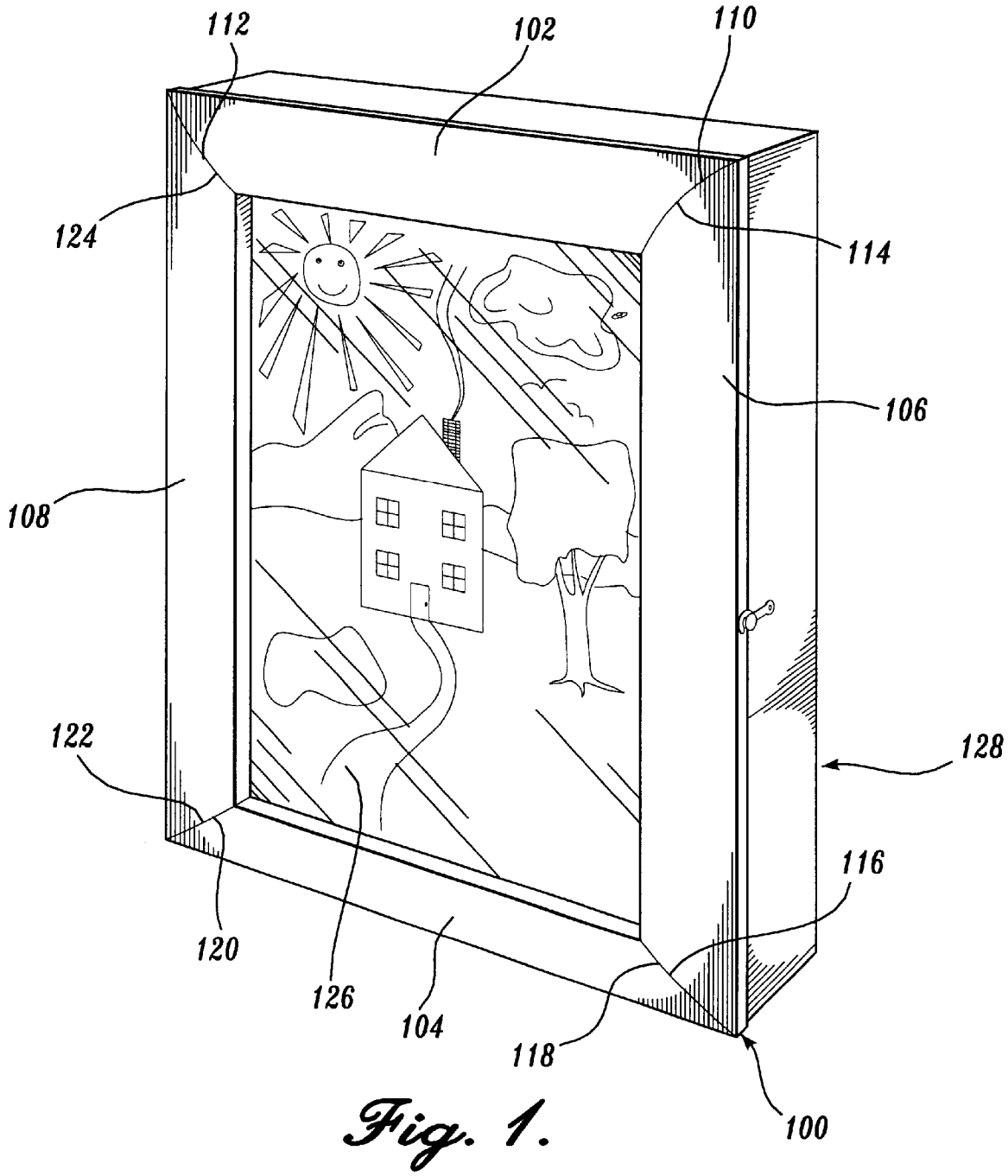
FIG. 1 is a perspective view of a display apparatus constructed in accordance with the present invention in the first closed position.

FIG. 1 shows a preferred embodiment of a display apparatus constructed in accordance with the present invention in a first or closed position. The display apparatus may serve equally well to display pictures or planar art work or any of a number of graphic displays produced in a planar medium. The display apparatus includes a first member 100 having four sides. For illustration purposes only, the first member may be described as having a top side 102, a bottom side 104, opposite the top side 102, a right side 106 connecting the right end of the top side 102 to the right end of the bottom side 104, and a left side 108, opposite the right side 106, and likewise connecting the left end of the top side 102 to the left end of the bottom side 104. The first member may be constructed from a plurality of members. For instance, in the preferred embodiment each side may be constructed from individual side pieces having beveled cuts at respective opposite ends to join with adjacent pieces. Thus, top side 102 is constructed from a single piece having beveled ends 110, 112. Right side 106 is constructed from a single piece having beveled ends 114, 116, where beveled end 110 of top side piece 102 is joined with beveled end 114 of right side piece. Bottom side 104 is constructed from a single piece having beveled ends 118, 120, where beveled end 112 of bottom side piece 104 is joined with beveled end 116 of right side piece 106. Left side 108 is constructed from a single piece having beveled ends 122, 124, where beveled end 122 of left side piece 108 is joined to beveled end 120 of bottom side piece 104, and beveled end 124 of left side piece 108 is joined with beveled end 112 of top side piece 102. Alternatively, first member 100 may also be constructed from a singular piece of material (not shown), as would be the case in a unitary plastic article. Alternatively, first member may have four orthogonal shaped pieces (not shown) for sides and four corner pieces (not shown) joining each of the respective side pieces to one another. Construction materials for first member 100 may be wood, plastic, metal, or like materials, or any combination thereof.

The display apparatus also includes a transparent restraining member 126. The transparent restraining member 126 may be constructed from glass or like material. Equally suitable to use as the transparent member 216 in a display apparatus constructed in accordance with the present invention is any of the transparent polymeric materials, which are sold under the trade names such as Lucite™, Acrylic™, Lexan™, Plexiglas™, or like materials.

Figure 2:
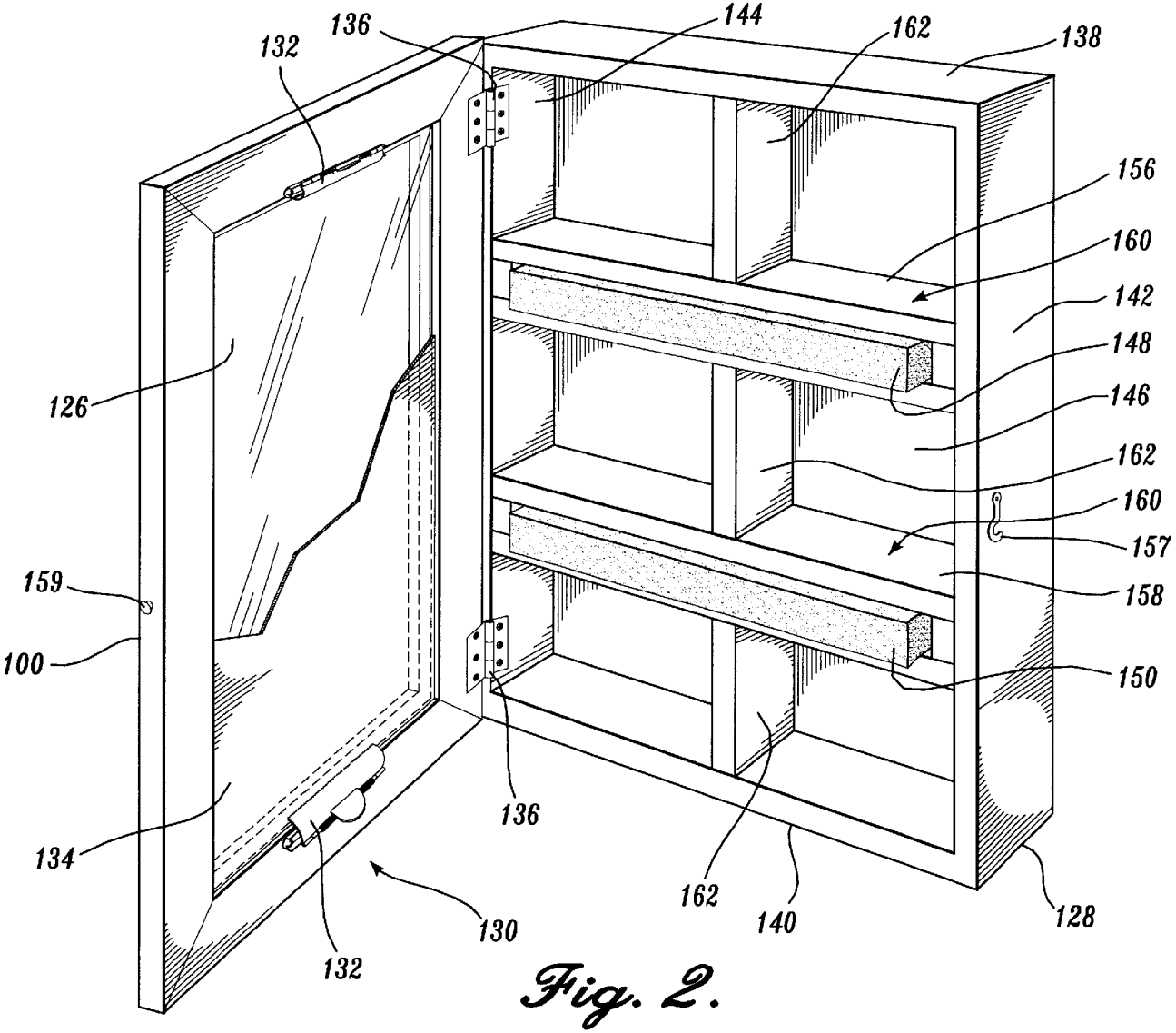
FIG. 2 is a perspective view of the display apparatus of FIG. 1 in the second open position.

First member 100 has a backside plane 130, which is visible when first member is moved to a second or open position as shown in FIG. 2. First member 100 defines in a center region a portion void of material such that display 134 may show therethrough. When viewed from the front side as shown in FIG. 1, first member appears as bordering the display 134. The central region is bordered by the sides of the first member 100 forming a perimeter around the central region. The inside perimeter of the center region is provided with a rabbet or ledge to suitably accommodate the transparent restraining member 126. When transparent restraining member 126 is placed within first member rabbet, transparent restraining member is substantially flush or even partly submerged within first member backside.

Still referring to FIG. 2, first member 100 may be provided with a plurality of holding devices 132 such as spring loaded grippers having serrated teeth to hold the display 134 against the transparent restraining member 126. Display 134 may also fit within the rabbet provided on the inner perimeter of the sides of the first member 100 so as to be substantially flush or submerged, or even slightly protruding with first member backside plane 130. Holding devices 132 may be disposed on inside top 102 and bottom 104 sides of first member 100. However, holding devices 132 may be placed with equal success on any and all sides of the first member backside plane 130. In addition to spring loaded grippers, holding devices 132 may be tangs (not shown) suitable to rotate about a pivot which causes a portion of the tangs to project into the center region when aligned vertically and do not project when the tangs are aligned horizontally. The projecting portion of the tangs holds the display in the first member 100. If tangs were located on left 108 or right sides 106 of first member backside plane 130, projection of tangs in center region would accordingly be affected to correspond with the tangs placement on the first member 100. Holding devices 132 hold the display 134 within first member 100 without the need for a backing sheet or backing plate. Thus, the display apparatus constructed in accordance with the present invention provides a method of removing displays from the apparatus without disassembly of the apparatus, an advantage not found in conventional picture frames.

In the preferred embodiment of FIG. 2, the display apparatus includes a second member 128 that is connected with the first member 100 through the use of hinging devices 136 which allow articulation and rotation of first member 100 relative to the second member 128 between a first closed position and a second open position. First member 100 is held in the second closed position with the use of a clasp. A clasp may take the form of a hook and pin or a hook and eye combination. Shown in FIG. 2 is a hook 157 and pin 159 combination. Other alternatives to the clasp may include magnets on one member and a magnetizable plate on the other member. In keeping with like materials of construction, second member 128 may be constructed from wood, plastics, metals, or any combination thereof. Second member 128 includes four sides and a back side. The four sides and back are preferably five individual orthogonal shaped pieces in varying three dimensions imparting length, width and thickness to each individual piece. However, as with the sides of the first member 100, the sides of the second member 128, may be constructed from one unitary piece or any number of a collection of pieces. Second member 128 is constructed with side pieces such that the front surface perimeter of the second member 128 has a constant width dimension. Adjacent pieces may be joined with dove tailed joints as is common in woodworking, although alternative materials may be joined by methods which are also well-known joining methods for the particular material of construction. For illustration purposes, the second member 128 may be said to have a top side 138, a bottom side 140 opposite the top side 138, a right side 142, substantially perpendicular to and connecting with one end of the top side 138 and the bottom side 140, and a left side 144, opposite the right side 142, and substantially perpendicular to and connecting with one end of the top side 138 and the bottom side 140. First and second members provide an overall appearance of the display apparatus having a box-like shape when in the closed position. The second member right side piece 142 and the left side piece 144 are longer in length than the top side piece 138 or bottom side piece 140. However, alternate embodiments may be constructed such that the distance from the right to the left side is longer than the distance from the top to the bottom side. In one embodiment, the distances may be substantially equal to each other so that the display apparatus resembles a square.

The orthogonal shape of the second member side pieces provide second member 128 with a depth dimension, thus creating volume within second member 128 when first member 100 is in the closed first position. Second member 128 has a backside 146, which substantially provides the second member 128 with a backside wall such that second member 128 has the appearance of a container when taken in combination with the second member side pieces. First member 100 may also be said to act as a lid or cover for the "container" created by second member 128.

Still referring to FIG. 2, the preferred embodiment of the display apparatus constructed in accordance with the present invention includes two biasing devices 148, 150 which exert an urging pressure against the display 134 for urging the display 134 against the transparent restraining member 126 when the first member 100 is in the closed, first position. The biasing devices 148, 150 are preferably constructed from a compressible material, such as foam rubber and like materials. The biasing devices 148, 150 exert the urging pressure by compressing when the display 134 is pushed against it. Therefore, in order to retain its function as a biasing device for a repeated number of cycles, the biasing devices 148 and 150 preferably have memory to decompress to their original shape once the display 134 is lifted from its contact surface. Biasing device material is chosen so as to provide a non-damaging contact surface such that as biasing devices 148, 150 are being urged against display 134, any rubbing effect has a negligible impact on the display 134. Biasing devices 148, 150 may, therefore, be urged against display 134 for a repeated number of times without the display 134 suffering any appreciable wear. This is the difference between the present invention and other display apparatus using metal springs which require an additional backing sheet to protect the display. Alternates of a biasing device may have more or less surface area. For example, an alternate of the biasing device may be a block that substantially presses against all of the display 134 area. Other alternates may have or more or less individual biasing devices in a vertical orientation on or any combination thereof.

In a preferred embodiment, biasing devices 148, 150 are orthogonal shaped, having a length substantially the distance between the right side 142 and the left side 144 of the second member 128, such that the biasing devices 148, 150 can fit lengthwise within the second member 128 right and left sides 142, 144. The lengthwise dimension of the biasing devices 148, 150 is substantially aligned parallel to the top side 138 or bottom side 140 of the second member 128. Biasing devices 148, 150 also have a height dimension, which dimension is aligned substantially parallel to the right side 142 or the left side 144 of the second member 128. Length and height dimensions of biasing devices 148, 150 form a surface area, the surface area being substantially parallel to the planar display 134 when in the closed, first position. In this manner, biasing device applies its urging pressure over a distributed area of the display 134. The force per unit area being minimized to reduce the stress on the display 134 at the contact surfaces between the biasing devices 148, 150 and the display 134 and the contact surfaces between the transparent restraining member 126 and the display 134.

Figure 3:
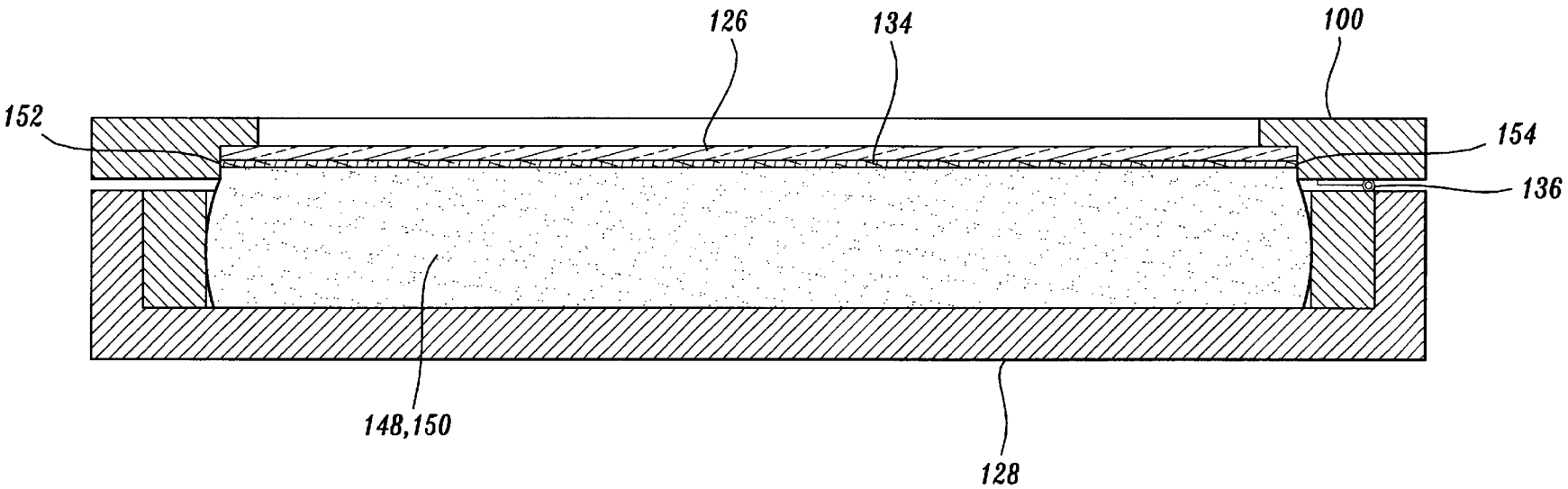
FIG. 3 is a cross-sectional view of the display apparatus of FIG. 1 in a horizontal plane.

Referring to FIG. 3, a preferred embodiment of the biasing devices are shown while first member 100 and second member 128 are in the first closed position, while the biasing devices 148, 150 are applying their urging pressure against the display 134. Biasing devices 148, 150 and the display 134 are adjacent to each other, such that the surface of the biasing devices 148, 150 lie in continuous and direct contact with the display 134, substantially from right side edge 152 of the display 134 to the left side edge 154 of the display 134. Biasing devices 148, 150 are shown in their biased, compressed state and will decompress to their non-biased state when urging pressure is lifted. The choice in material and the distribution of urging forces over a distributed area allow the biasing devices 148, 150 and display 136 to be in continuous direct contact, which eliminates the need for a backing sheet (not shown) or a backing plate (not shown), which is required for conventional display apparatus to hold display 134 prone against the transparent restraining member 126.

Other embodiments of the biasing devices may have circular or oval surface areas. Still, other shapes may have the length and width dimensions adjusted to provide urging pressure in different locations relative to the display 134.

Referring now to FIG. 2, in the preferred embodiment, the display apparatus includes two biasing devices 148, 150, such that a first biasing device 148 is provided approximately two-thirds the distance from the bottom side 140 to the top side 138 and the second biasing device 150 is provided one-third the distance from the bottom side 140 to the top side 138. Other alternatives may have first 148 and second biasing device 150 more or less spaced apart from one another. Still, other alternatives may provide biasing devices 148, 150 in a crisscross pattern, or lengthwise from top to bottom rather than from left to right, and still others may use any combination of configurations including any round or arcuate shapes.

Figure 4:
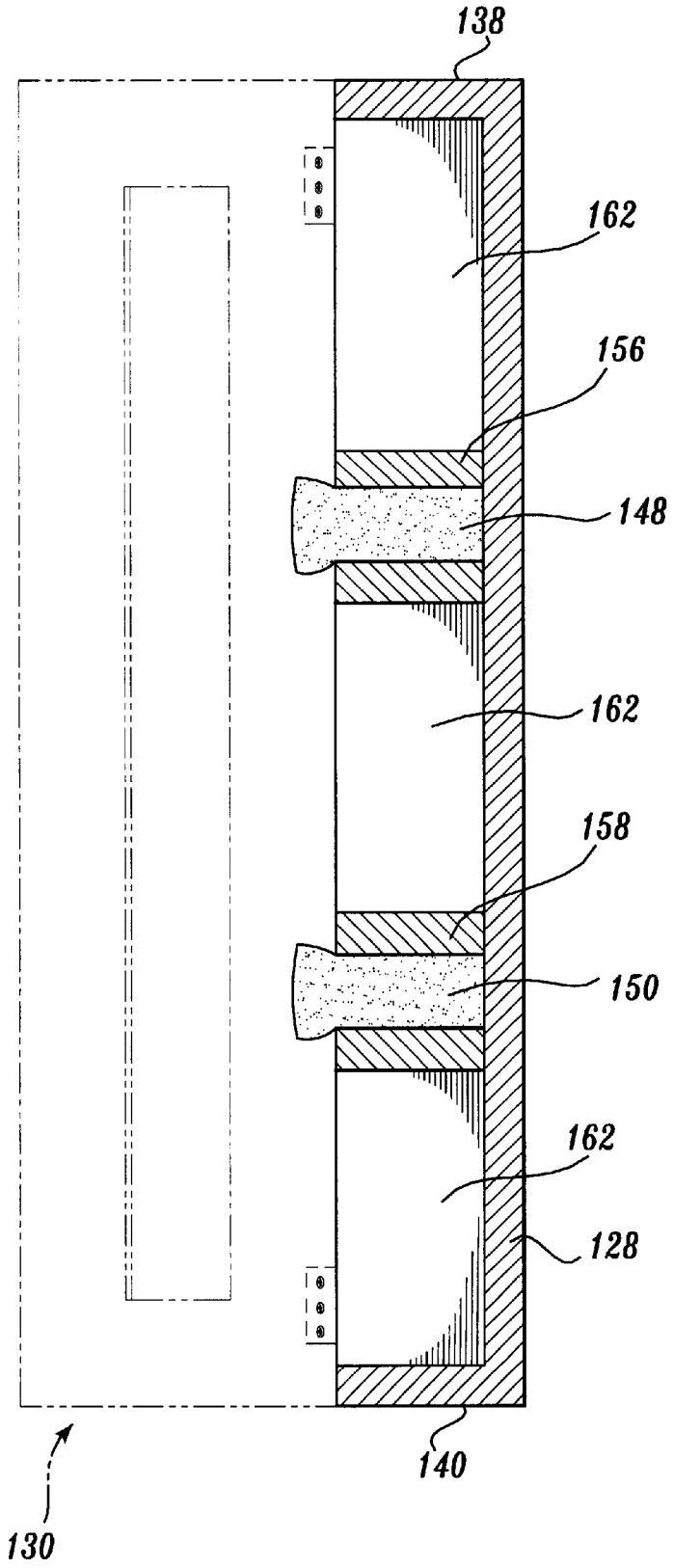
FIG. 4 is another cross-sectional view of the display apparatus of FIG. 1 in a vertical plane.

Still referring to FIG. 2, the display apparatus constructed in accordance with the present invention also includes retainers 156, 158 to retain or hold the biasing devices 148, 150 within the second member 128. The retainers 156, 158 are constructed from individual pieces or they may be constructed from a single piece of material. The retainers 156, 158 provide an aperture, such that biasing devices 148, 150 may snugly fit within the apertures created by retainers 156, 158. Biasing device material is such that the biasing devices are held in place by a slight interference fit between the biasing devices 148, 150 and the retainers 156, 158, such that the biasing devices 148, 150 are slightly compressed as shown in FIG. 4. Now, referring again to FIG. 2, the retainers 156, 158 are constructed such that they will either form a ledge 160 or a divider 162 or any combination thereof to provide storage capability to the second member 128 in the form of individual storage constructs. In the preferred embodiment, the retainers 156, 158 which retain the biasing devices 148, 150 in a right to left configuration are such that retainers 156, 158 each form one of the sides of a storage construct. A storage construct is defined by four sides, or walls formed by any part of the retainers, dividers, and sides of the second member 128. As illustrated in FIG. 2, retainer 158 forms a ledge 160 in this embodiment. In other alternatives where biasing devices 148, 150 are aligned top to bottom rather than from right to left, retainers may act as dividers 162 or walls for the storage constructs. The back piece and side pieces of the second member 128 in combination with the retainers 156, 158 complete the storage constructs. In the preferred embodiment, six storage constructs are provided within the second member 128. First 156 and second 158 retainers form top and bottom walls of the storage constructs while divider walls, generally denoted by 162, are provided to increase the number of storage constructs. Walls 162 may be deleted to provide for three storage constructs, or any number may be added or deleted to arrive at any desired number of storage constructs.

Finally, the preferred embodiment of the display apparatus has mounting hardware (not shown) for mounting the display apparatus on a wall. Mounting hardware can be any suitable hardware which is widely available. The preferred embodiment of the display apparatus is mounted so that first member 100 pivots about a vertical axis. However, other alternatives may have hardware to enable mounting so first member 100 pivots about a horizontal axis. In one alternate, the display apparatus can have both types of mounting hardware, such that the display apparatus can be mounted both horizontally and vertically, giving the option of having a first member with vertical or horizontal pivoting capabilities. This would be desirable in the case where an obstruction is encountered while moving the first member in one direction, but is not obstructed if the display apparatus were rotated allowing the first member to open from a different direction.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A display apparatus for a display, comprising:

a first member having four sides;

a transparent restraining member mounted centrally within the four sides of the first member;

a second member having four sides and a back, wherein the first and second member are swingably interconnected on at least one side thereof, such that the first member swings between a first position and a second position;

at least one holding device located on the first member for holding a display as the first member swings from the first to the second position and back to the first position;

at least one biasing device located on the second member for exerting an urging pressure for urging the display against the transparent restraining member when the first member is in the first position, the at least one biasing device including a compressible material with memory, and the material is in substantially direct and a continuous contact with the display, distributing the urging pressure along a continuous area of the display while the first member is in the first position; and at least one retainer located on the second member for retaining the biasing device within the second member.

2. The display apparatus of claim 1, wherein the urging pressure is substantially evenly applied along a portion of the display from substantially one edge to the other edge of the display.

3. The display apparatus of claim 2, wherein the retainer forms a portion of at least one storage construct.

4. The display apparatus of claim 3, comprising:

a second biasing device located on the second member for exerting an urging pressure for urging the display against the transparent restraining member when the first member is in the first position, the second biasing device including a compressible material with memory, and the material is in substantially direct and continuous contact with the display, distributing the urging pressure along a continuous area of the display while the first member is in the first position; and a second retainer located on the second member for retaining the second biasing device within the second member.

5. The display apparatus of claim 4, wherein the at least one holding device comprises a spring loaded gripper for holding the display in the first member without the use of a backing sheet or plate.

6. The display apparatus of claim 5, wherein the at least one and the second retainer further comprise walls to form portions of storage constructs.

7. The display apparatus of claim 6, wherein the at least one and the second biasing device are compressible material.

8. The display apparatus of claim 7, wherein the compressible material has a non-damaging contact surface such that a backing sheet is not required to be placed between the biasing device and the display.

* * * * *

UNITED STATES PATENT AND TRADEMARK OFFICE

CERTIFICATE OF CORRECTION

PATENT NO. : 6,349,494 B1
DATED : February 26, 2002
INVENTOR(S) : D.J. Haggarty-Robbins It is certified that error appears in the above-identified patent and that said Letters Patent is hereby corrected as shown below:

Title page,
Item [56], References Cited, U.S. PATENT DOCUMENTS, insert in appropriate order the following: --

| | | |
|---|---|---|
| 231,473 | 8/1880 | Brower |
| 292,789 | 2/1884 | Burdick |
| 605,959 | 6/1898 | Henderson |
| 1,388,010 | 8/1921 | Watson |
| 1,980,687 | 11/1934 | Lassen -- |

Signed and Sealed this

Third Day of December, 2002

JAMES E. ROGAN
*Director of the United States Patent and Trademark Office*